US005390452A

United States Patent [19]

Eckert

[11] Patent Number: 5,390,452

[45] Date of Patent: Feb. 21, 1995

[54] MODULAR BUILDING BLOCK

[75] Inventor: Werner Eckert, Albbruck-Buch, Germany

[73] Assignee: Lignotrend Holzblocktafel Systeme GmbH, Weilheim-Bannholz, Germany

[21] Appl. No.: 41,951

[22] Filed: Apr. 2, 1993

[30] Foreign Application Priority Data

Apr. 4, 1992 [DE] Germany ..... 4211380

[51] Int. Cl.[6] ..... E04B 1/346

[52] U.S. Cl. ..... 52/71; 52/646; 52/726.2; 52/730.1; 446/104; 446/115

[58] Field of Search ..... 52/70, 71, 645, 646, 52/726.1, 726.2, 730.1; 446/104, 109, 115, 125

[56] References Cited

U.S. PATENT DOCUMENTS

| | | | |
|---|---|---|---|
| 2,716,993 | 9/1955 | Codrick | 135/4 |
| 2,835,931 | 5/1958 | Sterkin | 52/70 |
| 2,855,617 | 10/1958 | Gustaf et al. | 14/13 |
| 3,120,076 | 2/1964 | Zuch | 52/70 X |
| 3,771,274 | 11/1973 | Vaughan | 52/646 |
| 4,118,901 | 10/1978 | Johnson | 52/70 X |
| 4,479,333 | 10/1984 | Hendrich | 52/70 X |
| 4,580,776 | 4/1986 | Burkinshaw | 52/70 X |
| 4,880,210 | 11/1989 | Cucksey | 52/70 X |
| 5,107,652 | 4/1992 | Sosa | 52/71 X |
| 5,132,156 | 7/1992 | Trassare, Jr. et al. | 52/70 X |

FOREIGN PATENT DOCUMENTS

| | | | |
|---|---|---|---|
| 158950B1 | 4/1990 | European Pat. Off. | E04H 12/18 |
| 2159969 | 6/1972 | Germany | F16S 3/08 |
| 2445515B2 | 7/1979 | Germany | E04B 1/19 |

*Primary Examiner*—Lanna Mai

*Attorney, Agent, or Firm*—Darby & Darby

[57] ABSTRACT

A building block wherein two elongated bars are pivotally connected to each other along their longitudinal edges by a first hinge and at least one end portion of each bar is provided with one or more parts of a second hinge which serves to articulately connect the respective end portion to one end portion of a bar forming part of an additional building block. The axes of the first and second hinges are normal to each other. The building blocks can be assembled into skeleton frames forming part of roof structures, erector sets, decorative arrangements, kiosks and/or other combinations of modules.

25 Claims, 5 Drawing Sheets

MODULAR BUILDING BLOCK

BACKGROUND OF THE INVENTION

The invention relates to improvements in building blocks which can be utilized as modules in construction work, for decorative or display purposes, in toy kits (such as erector sets) and for many other purposes. More particularly, the invention relates to improvements in building blocks which can be separably or permanently coupled with identical, similar or different building blocks to constitute skeleton frames of racks, roofs or other composite structures.

Supporting frameworks which form part of roofs, turrets, domes and like building structures are often assembled of prefabricated building blocks or modules which are coupled to each other to constitute a skeleton frame adapted to be employed to support laths, panels, planks, plates, sheets or other covering devices. The connections between the constituents of individual building blocks and/or between neighboring building blocks can include or constitute universal joints (such as spherical joints) or other types of junctions (e.g., those which employ discs). For example, a junction between two or more components of a building block can comprise a sphere which is made of a metallic material and whose surface is provided with a plurality of tapped bores or holes (e.g., with up to 18 bores or holes) for reception of rod-shaped components of building blocks. The end portions of the rod-shaped components are provided with external threads which are designed to mate with internal threads in the tapped bores or holes of the spherical junction.

Kits including building block components and junctions of the above outlined character enjoy a reasonable amount of popularity in certain fields, e.g., in certain branches of the construction industry wherein rapid assembly of different types of frames or like skeleton structures is of importance. However, such kits exhibit a number of drawbacks, especially as regards their versatility and reliability. For example, the mutual inclination of rods which are connected to a spherical junction cannot be changed so that a different junction must be employed whenever the required mutual inclination of two or more rods departs from a standard value. Furthermore, each of two or more different types of connections between those end portions of the rods which are remote from a spherical junction must be individually designed, constructed and assembled with attendant increase in the overall cost of a reasonably complex framework or the like. Special designs for connections between different sets of rods in one and the same skeleton frame or the like render the cost of such frames prohibitive for a number of applications, for example, in inexpensive erector kits or similar toy devices.

Another drawback of the aforedescribed skeleton frames which employ spherical junctions with tapped bores or holes and elongated rod-shaped components with externally threaded end portions is that the components can only transmit and/or take up relatively small torsional stresses. Moreover, if a skeleton frame employing one or more spherical junctions for externally threaded rod-shaped components is to be encased in a jacket or envelope consisting of panels, boards or the like, e.g., to constitute the roof of a building or a portion of a building, the components must be specially designed or they must be provided with specially designed attachments or adapters in order to be connectable with panels, planks, plates or like covering parts. This, too, contributes significantly to the complexity and cost of such skeleton structures.

OBJECTS OF THE INVENTION

An object of the invention is to provide a building block or module which is more versatile than heretofore known building blocks.

Another object of the invention is to provide a building block which can be assembled with identical, similar or different building blocks into skeleton frames or like structures in a simple and time saving manner and without the need for any tools or by resorting to rudimentary tools.

A further object of the invention is to provide a building block which can be mass produced in available machines, which comprises or can comprise a relatively small number of parts, and which can be designed to stand pronounced torsional and/or other stresses such as develop in buildings, roofs of buildings and in like structures.

An additional object of the invention is to provide a simple, compact and reliable building block which need not employ internally and/or externally threaded components.

Still another object of the invention is to provide a novel and improved combination of two or more building blocks at least one of which exhibits the above outlined features and advantages.

A further object of the invention is to provide a novel and improved method of making and manipulating a building block of the above outlined character.

SUMMARY OF THE INVENTION

The invention is embodied in a building block or module for use in conjunction with identical, similar or different building blocks. The improved building block comprises two elongated components each having at least one longitudinally extending edge and two end portions, means for articulately connecting the two elongated components at their edges for angular movement about a first axis, and a plurality of coupling means, at least one for each elongated component and each including means for articulately securing one end portion of the respective elongated component to a component of an additional building block for angular movement about a second axis which is normal to the first axis. The first axis and the second axes cross each other at a common point outside of the two elongated components.

The connecting means can comprise or constitute a first hinge, and each of the securing means can form part of a discrete second hinge.

Each elongated component can constitute or resemble a bar, and such bars are or can be parallel to each other.

At least one of the two elongated components can be provided with a facet which is adjacent the respective second axis and is positioned to limit the extent of angular movability of the at least one elongated component about the respective second axis relative to a component of an additional building block which is articulately secured to the at least one elongated component by the respective coupling means.

Each of the two elongated components can have a substantially rectangular cross sectional outline and an elongated side flanked by two longitudinally extending edges including the respective at least one edge. The at least one end portion of each elongated component is or can be at least substantially normal to the first axis, and the second axes are preferably adjacent the elongated sides of the respective elongated components.

If the connecting means comprises or constitutes a hinge, it can comprise at least one knuckle at each end portion of each of the two elongated components. The knuckles of one of the two elongated components are aligned with the knuckles of the other elongated component, and such hinge can further comprise a pintle (e.g., a one-piece pintle or a pintle composed of two or more discrete coaxial sections, i.e., shorter pintles). The pintle defines the first axis and extends through the aligned knuckles of the two elongated components. At least one knuckle of one of the elongated components is preferably disposed between two knuckles of the other elongated component.

Each of the two elongated components can be provided with two mutually inclined sides which are disposed in planes crossing each other at the respective edge, and at least one of the neighboring edges of the two elongated components can be bevelled (e.g., rounded or flattened). The two planes cross each other along the first axis.

At least one of the securing means can also comprise at least one knuckle provided on the one end portion of the respective elongated component and serving to receive a pintle further extending through at least one knuckle at one end portion of an elongated component forming part of an additional building block and defining the respective second axis. The at least one securing means can comprise a plurality of spaced apart aligned knuckles.

The two elongated components of the improved building block can be mirror images of each other with reference to a plane which includes the first axis.

Each elongated component can include a first side which is flanked by two longitudinally extending edges including the respective at least one edge and a second edge, and a second side which is inclined relative to the first side. The first and second sides flank the second edge of the respective elongated component and such first and second sides can be at least substantially normal to each other. The second side can serve as a base or support for one or more parts, e.g., one or more planks, panels or laths if the improved building block is utilized at a construction site for the erection of a dome, cupola, another form of a roof or the like.

At least one of the two elongated components can consist of or can contain wood, a metallic material or a plastic material. If the material is a metallic or a plastic material, the at least one elongated component can constitute an extrusion.

Furthermore, at least a portion (e.g., the knuckles) of at least one of the connecting means and securing means can consist of a metallic or plastic material. Certain elements (such as the aforediscussed knuckles) of the securing means and/or connecting means can be affixed to the corresponding elongated component by snap action; such elements are or can be made of a suitable plastic material. Alternatively, the elements (e.g., metallic or plastic elements) can be of one piece with the respective elongated component.

The novel features which are considered as characteristic of the invention are set forth in particular in the appended claims. The improved building block itself, however, both as to its construction and the mode of making and using the same, together with additional features and advantages thereof, will be best understood upon perusal of the following detailed description of certain presently preferred specific embodiments with reference to the accompanying drawings.

DESCRIPTION OF PREFERRED EMBODIMENTS

Figure 1:
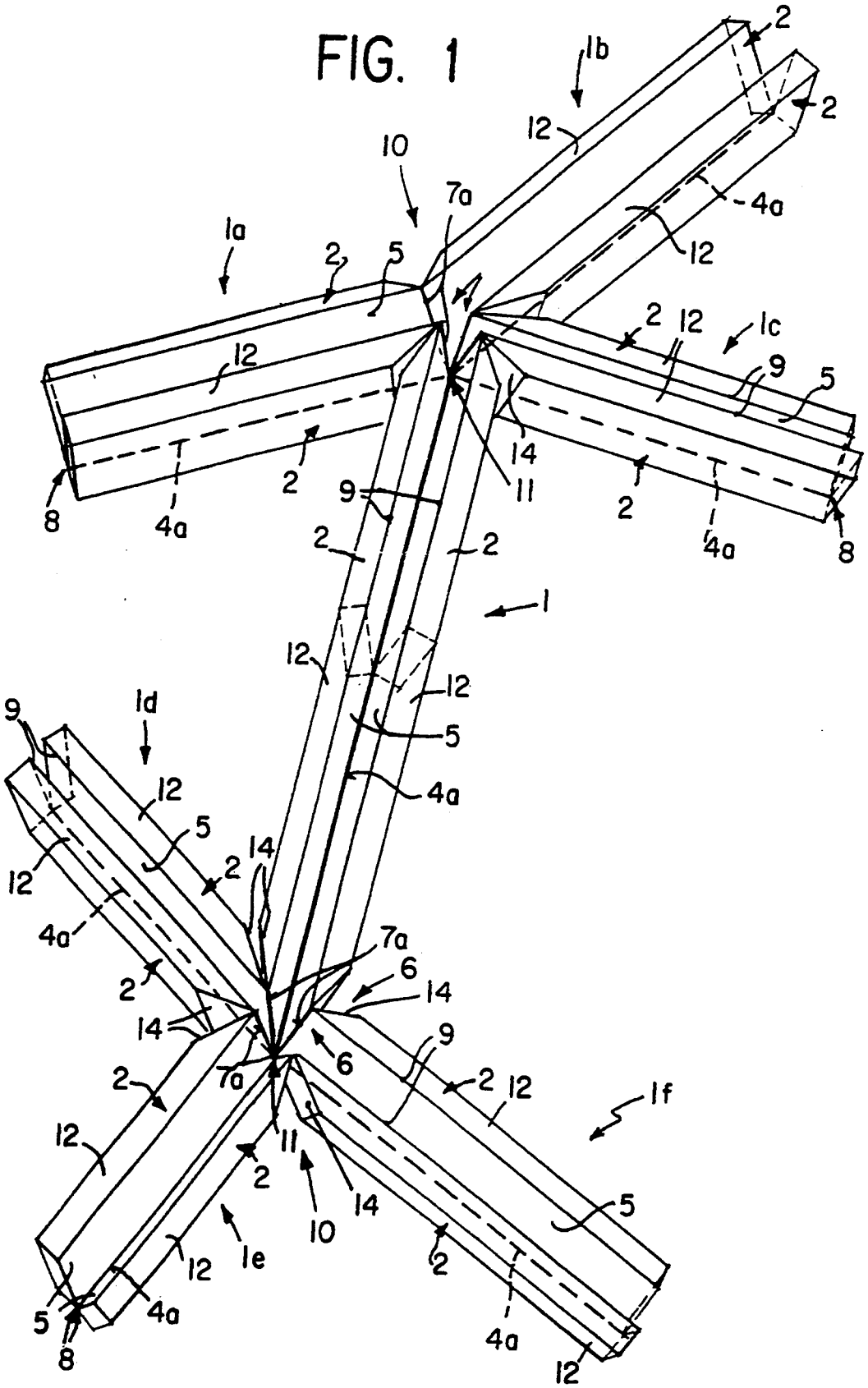
FIG. 1 is a schematic perspective view of a skeleton structure employing seven interconnected building blocks each of which embodies one form of the present invention.

FIG. 1 shows a skeleton frame which includes a total of seven building blocks or modules 1, 1*a*, 1*b*, 1*c*, 1*d*, 1*e*, 1*f* each of which embodies one form of the present invention. Referring, for example, to the building block 1, this part of the skeleton frame includes two elongated components in the form of parallel bars 2 each having a main or median portion with a substantially rectangular cross-sectional outline (see also FIGS. 3, 4, 5*a*, 8*a* and 11*a*). The bars 2 have neighboring elongated edges 8 (see particularly FIG. 3) which are articulately connected to each other by an elongated hinge 4 defining an elongated pivot axis 4*a* which is parallel to and can coincide with the edges 8 of the bars 2 forming part of the building block 1. The hinge 4 enables the neighboring elongated sides 5 of the two elongated components or bars 2 to move toward or away from each other, i.e., to move the elongated edges 9 nearer to or further away from one another. The edges 9 are parallel to the respective edges 8 and, as shown in FIG. 4, the hinge 4 can be provided at the edges 9 in lieu of at the edges 8. To this end, pairs of aligned eyelets or knuckles 15 are provided at each of the two end portions 6 of each bar 2, namely a total of two pairs at the edge 8 and a total of two pairs at the edge 9 of each bar 2. This enhances the versatility of the improved building block because all that is necessary to complete a hinge 4 at the edges 8 or at the edges 9 is to employ a suitable shaft P (hereinafter called pintle) which extends through the aligned knuckles 15 at the two edges 8 or at the two edges 9 to thus ensure that the bars 2 are properly connected to each other for angular movement about an axis 4*a* which is adjacent to or coincides with the two edges 8 or about an axis which is adjacent to or coincides with the two edges 9.

The end portions 6 of each of the two bars 2 each carry certain parts (knuckles 16) of a coupling means including a second hinge 7 defining an axis 7*a* which is normal to and crosses the axis 4*a* outside of the bars 2 at a common point 11. Each second hinge 7 serves to angularly movably secure the respective end portion 6 of a bar 2 forming part of a building block (such as the block 1) to the end portion of a bar forming part of an additional building block (such as the building block 1*a*, 1*b*, 1*c*, 1*d*, 1*e* or 1*f* of FIG. 1). This enables the thus interconnected bars 2 of two neighboring building blocks (e.g., 1 and 1*a*) to pivot relative to one another about the respective axis 7*a*; at the same time, each of the thus coupled bars 2 is free to pivot about the corresponding axis 4*a*, i.e., relative to the other bar 2 of the respective building block.

The hinges 4 and 7 which are used in the skeleton frame of FIG. 1 are indicated solely by their respective axes 4*a* and 7*a*. Each such hinge preferably comprises at least two aligned knuckles 15 (hinges 4) or 16 (hinges 7) provided on the two bars 2 of one and the same building block (1 or 1*a*) or on the neighboring bars of two discrete building blocks (such as 1 and 1*a* in FIG. 1), and a one-piece pintle P or PP or a pintle consisting of two or more coaxial sections. The arrangement is preferably such that at least one knuckle 15 on one of the neighboring bars 2 belonging to one and the same building block (such as 1 or 1*a*) is disposed between two suitably spaced-apart knuckles 15 on the other of the two neighboring bars 2 belonging to one and the same building block. The same holds true for the knuckles 16 of the hinges 7.

Figure 2:
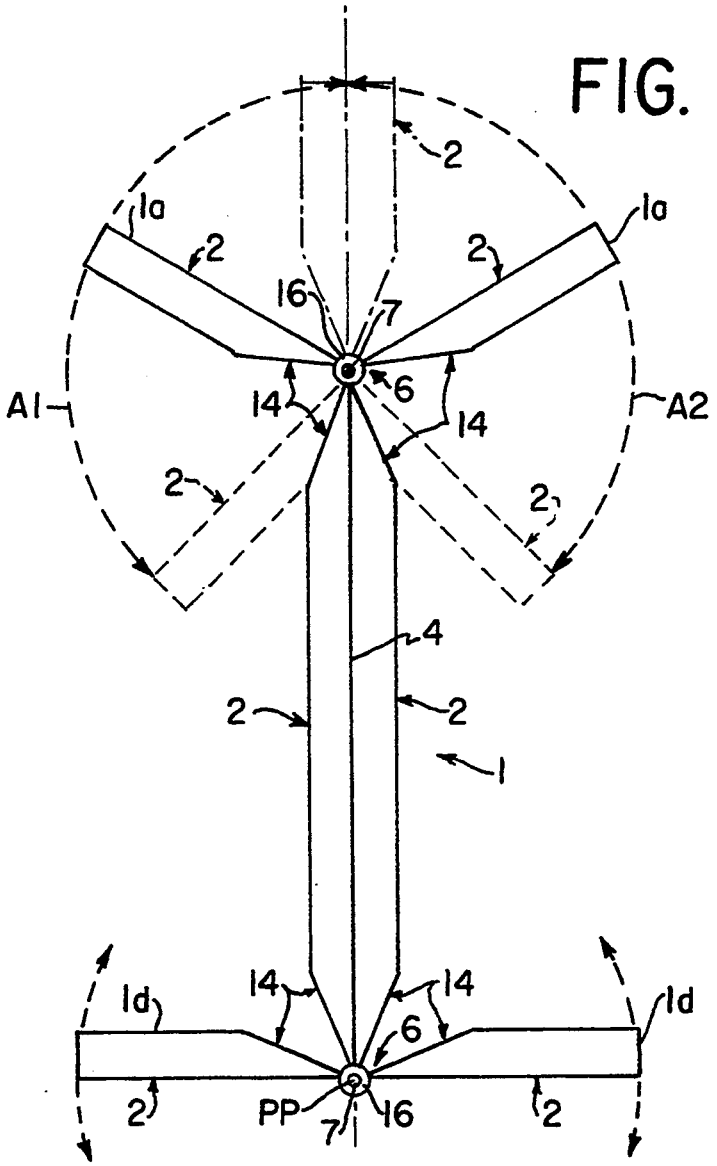
FIG. 2 is a smaller-scale schematic plan view of three interconnected building blocks two of which are shown in different stages of assembly and in different positions relative to the third building block.
Figure 3:
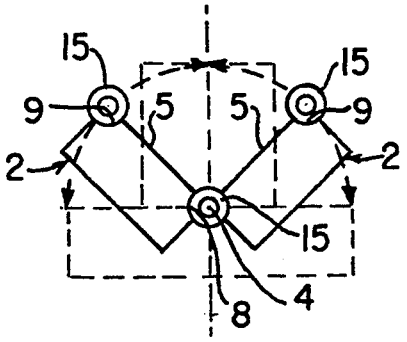
FIG. 3 is an end elevational view of a building block of the type shown in FIGS. 1 and 2.
Figure 4:
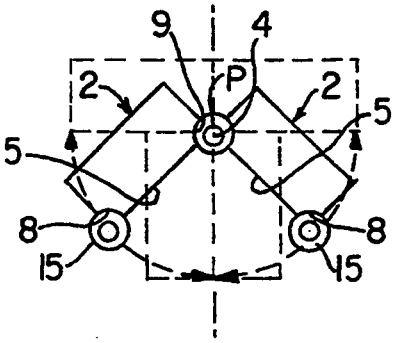
FIG. 4 is a similar end elevational view of the building block of FIG. 3 but with its elongated components articulately connected to each other in a different way.
Figure 5:
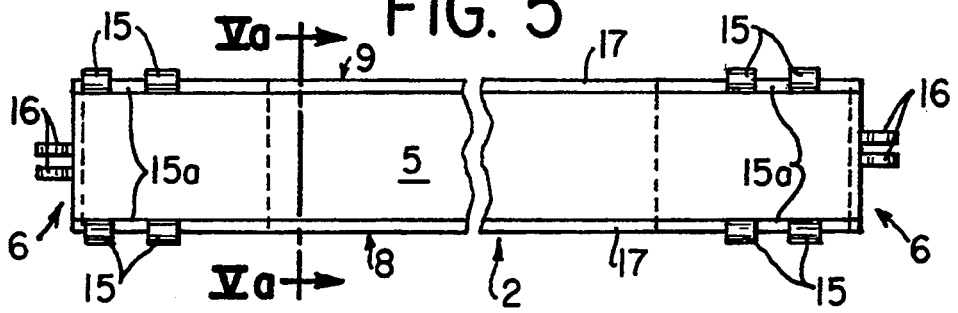
FIG. 5 is a fragmentary side elevational view of one elongated component of a building block of the type shown in FIGS. 1 to 4.
Figure 5A:
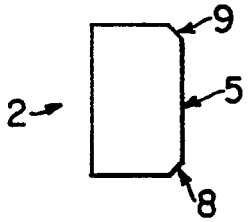
FIG. 5*a* is a cross-sectional view substantially as seen in the direction of arrows from the line Va—Va in FIG. 5.
Figure 6:
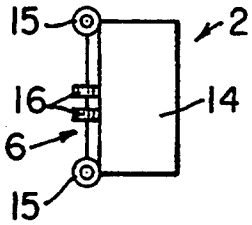
FIG. 6 is an end elevational view as seen from the left-hand side of FIG. 5.
Figure 7:
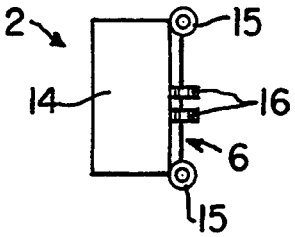
FIG. 7 is an end elevational view as seen from the right-hand side of FIG. 5.
Figure 8:
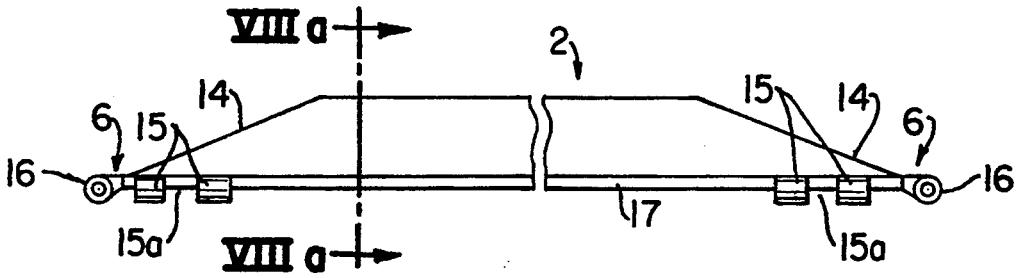
FIG. 8 is a fragmentary side elevational view similar to that of FIG. 5 but showing the elongated component turned through an angle of 90° relative to the position of FIG. 5.
Figure 8A:
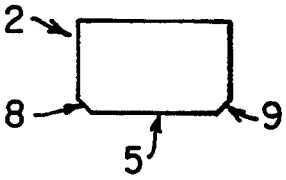
FIG. 8*a* is a sectional view substantially as seen in the direction of arrows from the line VIIIa—VIIIa in FIG. 8.
Figure 9:
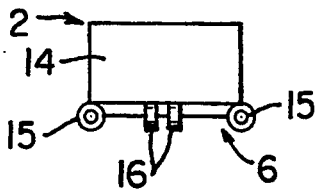
FIG. 9 is an end elevational view as seen from the left-hand side of FIG. 8.
Figure 10:
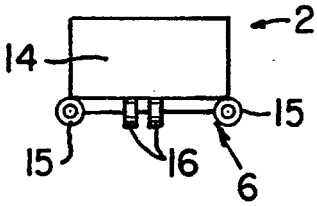
FIG. 10 is an end elevational view as seen from the right-hand side of FIG. 8.
Figure 11:
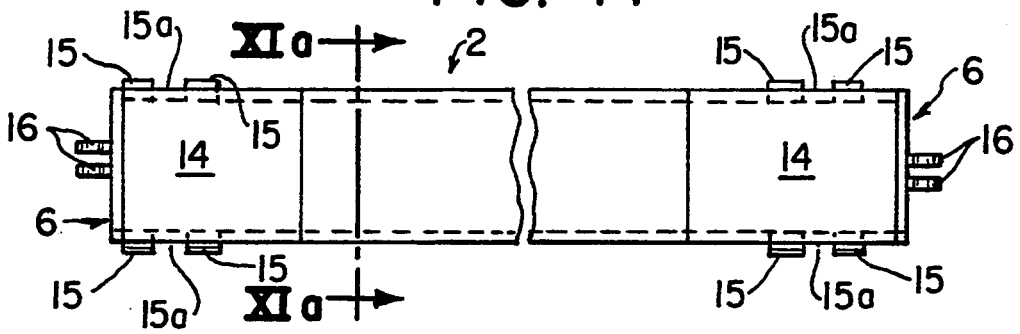
FIG. 11 is a fragmentary side elevational view similar to that of FIG. 8 but showing the elongated component turned through 90° relative to the position of FIG. 8.
Figure 11A:
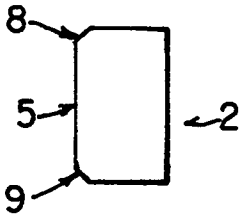
FIG. 11*a* is a sectional view substantially as seen in the direction of arrows from the line XIa—XIa in FIG. 11.
Figure 12:
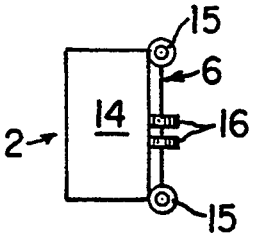
FIG. 12 is an end elevational view as seen from the left-hand side of FIG. 11.
Figure 13:
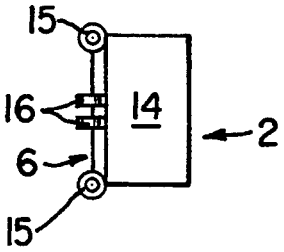
FIG. 13 is an end elevational view as seen from the right-hand side of FIG. 11.
Figure 14:
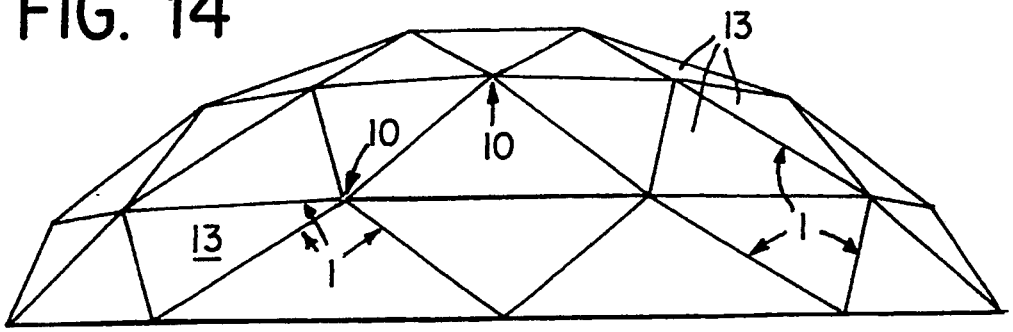
FIG. 14 is a schematic side elevational view of a structure which employs a plurality of improved building blocks.
Figure 15:
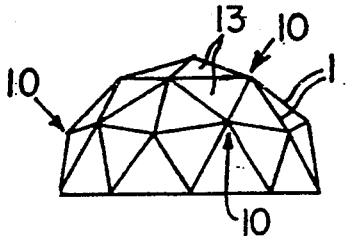
FIG. 15 is a schematic elevational view of a modified structure.
Figure 16:
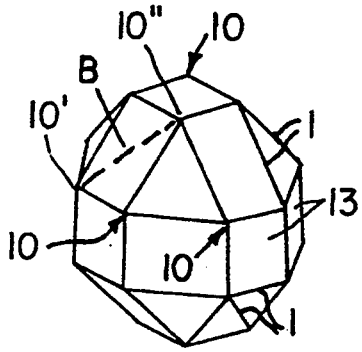
FIG. 16 is a schematic perspective view of a third structure.
Figure 17:
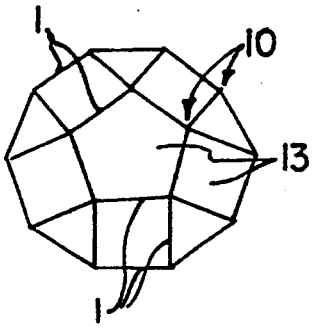
FIG. 17 is a plan view of a fourth structure.
Figure 18:
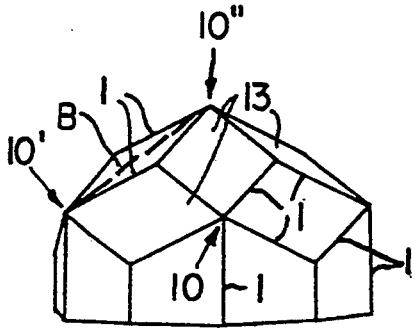
FIG. 18 is a side elevational view of a fifth structure.
Figure 19:
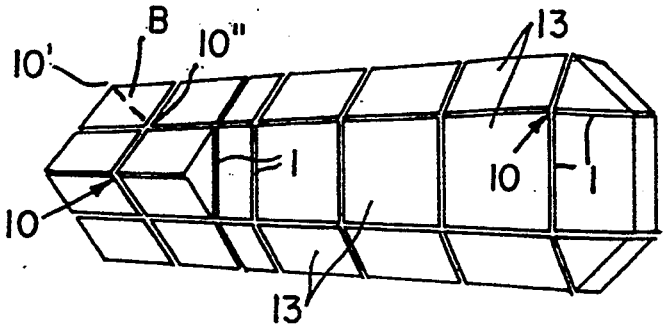
FIG. 19 is a perspective view of a sixth structure.

The versatility of the improved skeleton frame (including two or more building blocks of the type shown in FIG. 1 at 1, 1*a*, 1*b*, 1*c*, 1*d*, 1*e* or 1*f*) will be readily appreciated by looking at FIGS. 2, 3 and 4 as well as at FIGS. 14 to 19 which illustrate several forms of assembled or substantially assembled skeleton frames each containing a substantial number of articulately coupled building blocks. As can be seen in the upper portion of FIG. 2, the bars 2 of the block 1*a* can be shorter than the bars 2 of the block 1, and the two shorter bars 2 of the block 1*a* can be disconnected from each other, i.e., the pintle P of the hinge 4 for such shorter bars can be removed, so that the shorter bars can pivot about the respective axes 7*a* through angles of approximately 135° between the phantom-line positions (in which each of the shorter bars 2 is coplanar with one elongated bar 2 of the block 1), through the solid-line positions and the broken-line positions of FIG. 2. Pivoting of the shorter bars 2 forming part of the block 1*a* beyond the broken-line positions shown at the top of FIG. 2 is prevented by cooperating facets or flats 14 provided on the bars 2 opposite their sides 5 and at least at one of the respective end portions 6 (i.e., at the respective axes 7*a*). The facet 14 of each shorter bar 2 can come into actual abutment with the facet 14 on the adjacent end portion 6 of the respective elongated bar 2 to thus limit the extent of angular movability of each shorter bar relative to the adjacent elongated bar 2 and/or vice versa.

Referring again to FIG. 1, the building blocks 1*a* and 1*b* are articulately coupled to each other in such angular positions that they constitute two sides of a hexagonal structure. The building blocks 1*b* and 1*c* are coupled to each other in angular positions in which they constitute two sides of a square structure; the same applies for the positions of the building blocks 1*e* and 1*f* as well as for the positions of the building blocks 1*d* and 1*e*. The building blocks 1, 1*c* and 1*f* constitute three sides of a pentagon. The building blocks 1, 1*a* and 1*d* constitute the sides of a triangular structure. Other combinations can be formed with equal facility. Furthermore, the elongated narrow sides 12 of the bars 2 forming part of any given building block (such as 1) can be suitably inclined to be properly oriented for adequately supporting the end portions of one or more planks, plates or panels 13 (FIGS. 14–19), e.g., to complete the making of a dome or any other suitable roof structure. A plank 13 can be supported, at the same time, by the sides 12 of the adjacent frames 1*a*, 1*d* or 1*c* and 1*f*, depending upon whether the planks, plates or panels are to overlie a triangular or a pentagonal portion of a skeleton frame which is assembled of the improved building blocks.

Each side 5 is disposed between the respective longitudinally extending edges 8 and 9 of a bar 2, and each side 12 preferably makes with the adjacent side 5 an angle of at least close to 90°. Each side 5 is disposed between two hinges 7 when each of the two end portions 6 of an elongated bar 2 is articulately coupled to one bar 2 of an additional building block. Reference may be had, for example, to the left-hand bar 2 of the building block 1 and the adjacent bars 2 of the building blocks 1*a* and 1*d* shown in FIG. 1. The hinges 7 in the upper portion of FIG. 1 together constitute a first junction 10 which articulately connects the upper end portions 6 of the bars 2 forming part of the building block 1 to the adjacent end portions of two bars respectively forming part of the blocks 1*a* and 1*c*. At the same time, two hinges 7 of the upper junction 10 articulately couple the bars 2 of the block 1*b* to the adjacent bars 2 of the blocks 1*a* and 1*c*. The lower junction 10 of FIG. 1 is or can be a mirror image of the upper junction 10. The junctions 10 constitute the corners of an assembled building system; this can be seen by looking at FIGS. 14 through 19.

Each of the imaginary points 11 of crossing between an axis 4*a* and one or more axes 7*a* is located outside of the respective bars 2 in order not to interfere with angular movements of the bars 2 of any single section and/or the angular movements of any two coupled-together building blocks relative to one another.

By assembling each building block of two elongated parallel bars 2 which are articulately connected to each other by a hinge 4, and by articulately coupling one or both end portions 6 of each bar 2 with one or more bars 2 forming part of one or more additional building blocks (which may but need not be identical or even similar to the illustrated building block 1, 1*a*, 1*b*, 1*c*, 1*d*, 1*e* and/or 1*f*), one can establish numerous cardan joints and one can transmit motion directly from one building block to the neighboring building block or blocks. Otherwise stated, a movement of a selected building block entails movements of building blocks which are coupled thereto, and such movements of neighboring building blocks take place in accordance with a predetermined pattern. For example, any pivoting of the bars 2 forming part of the building block 1 which is shown in FIG. 1 about the axis 4*a* of the hinge 4 between their edges 8 entails a pivoting of the sides 5 of such blocks relative to each other about the axis 4*a* and this, in turn, entails a movement of the sides 12 of the two bars 2 to predetermined positions relative to each other because each side 12 is or can be normal to the respective side 5. As already mentioned above, the sides 12 can be connected with, or they can serve as supports or abutments for, end portions or marginal portions of planks, panels 13 (FIGS. 14 to 19) or other plate-like or analogous devices which overlie the joined-together building blocks in a dome, cupola, turret or analogous roof-like building system employing the improved building block(s) 1 and/or 1, 1*a* and/or 1, 1*a*, 1*b* and/or 1, 1*a*, 1*b*, 1*c* and so forth. The thus applied panels 13 or like parts can constitute the exposed covering of a roof or the like.

It is not absolutely necessary that each elongated side 5 of a bar 2 be disposed in a plane which is exactly normal to the plane of the corresponding elongated side 12. For example, the inclination of the sides 5, 12 on a bar 2 relative to each other can deviate from 90° if the flat or planar panels 13 which are shown in FIGS. 14 to 19 are replaced with partly spherical (concavo-convex) cover plates or panels. Irrespective of the exact inclination of the sides 5 and 12 on a bar 2 relative to each other, a change of the orientation or inclination of the sides 12 on interconnected bars 2 takes place automatically in response to any change of position of one of the coupled-together bars.

As already mentioned above, and as shown in FIG. 2, the hinge or hinges 4 between the bars 2 of one or more building blocks (1*a*, 1*d*) can be omitted if it is desired that each bar 2 of a given building block be pivotable about the respective axis 7*a* independently of the other bar forming part of the same building block. Thus, the hinge 4 between the bars 2 of the building block 1*a* in the upper portion of FIG. 2 is omitted in part (its pintle P is removed) so that the bars 2 of the block 1*a* are free to pivot relative to each other about the respective axes 7*a*. The same applies for the bars 2 of the block 1*d* which is shown in the lower portion of FIG. 2. Such disengageability of one or more hinges 4 contributes significantly to versatility of the improved skeleton frame. For example, the hinges 7 (not shown) at those ends of the bars 2 forming part of the block la in FIG. 2 which are remote from the bars 2 of the block 1 can be moved to any one of a practically infinite number of different positions along arcuate paths A1 and A2 which are indicated in FIG. 2 by broken lines. The facets 14 serve to limit the extent of pivotability of the coupled-together bars 2 forming part of neighboring building blocks (such as 1 and 1*a* in FIG. 2) relative to each other. Certain bars can be shortened (as shown in FIG. 2) in order to ensure that the assembled frame will occupy a prescribed amount of space, e.g., at the top of a group of walls which are to be overlapped by a suitably configurated roof structure. By properly selecting the inclination of the facets 14 relative to the sides 5 of the respective bars 2, one can determine in advance the maximum extent of pivotability of two coupled-together bars 2 (forming part of two neighboring building blocks (such as 1 and 1*a* in FIG. 2) relative to each other. The illustrated maximum angles are close to or exactly 135°.

By transporting a pintle P from the knuckles 15 at the edges 8 of two neighboring bars 2 into the knuckles 15 at the edges 9 of the same bars 2, one can convert the building block of FIG. 3 into the building block of FIG. 4. In other words, the sides 5 of two bars 2 forming part of an improved building block can be nearest to each other at the respective edges 8 (FIG. 3) or at the respective edges 9 (FIG. 4).

FIGS. 5 to 13 illustrate in somewhat greater detail certain parts of an improved building block. As can be seen, for example, in FIG. 5, each of the two end portions 6 of a bar 2 can carry two pairs of aligned knuckles 15 in the form of eyelets, sleeves or the like, namely one pair at the edge 8 and the other pair at the edge 9. The spacing of a pair of knuckles 15 from one end of a bar 2 is preferably different from the spacing of the corresponding pair of knuckles 15 (i.e., of the knuckles at the same edge 8 or 9) at the other end of the same bar. This renders it possible to fit at least one knuckle 15 on one bar 2 of one building block between two knuckles 15 on the other bar of the same building block. If a hinge 4 must be exceptionally strong, additional knuckles 15 can be provided between the end portions 6 of the respective bars 2 so that a pintle P will pass through more than a total of eight knuckles 8. The properly inserted pintle P then defines the respective axis 4*a*. As already mentioned above, a knuckle 15 forming part of a bar 2 belonging to a first building block preferably extends into the clearance or gap 15*a* between two aligned knuckles on a bar 2 forming part of the same building block provided, of course, that the respective hinge 4 is fully assembled, i.e., that its pintle P extends through all of the aligned knuckles 15 along the edges 8 or 9 of two neighboring parallel bars 2 forming part of a building block 1, 1*a*, 1*b*, etc.

The clearances or gaps 15*a* can be designed to snugly receive discrete knuckles 15.

An advantage of the just described distribution of knuckles 15 at the end portions 6 of the building blocks is that all of the bars 2 can be identical (if the length of bars in coupled-together building blocks is the same). This reduces the cost of a skeleton frame and contributes to versatility of the bars 2 forming part of the improved building blocks.

The reference numerals 17 denote in FIGS. 5 to 13 bevels or similar formations (e.g., convex formations) at the edges 8 and 9, i.e., adjacent the axis 4*a* of the hinge 4 which is used to articulately connect the bars 2 of a building block to one another, either at the edges 8 or at the edges 9.

The construction of the hinges 7 is analogous to that of the hinges 4 except that the relatively short hinges 7 will (or can) employ a smaller number of knuckles 16 in the form of eyelets, sleeves or the like. The distribution of knuckles 16 at the end portions 6 of a bar 2 is such that the axis *7a* of a pintle PP which is inserted into the aligned knuckles 16 of two neighboring bars 2 belonging to two discrete building blocks will be normal to the respective axis *4a*. The axis *4a* is coplanar with the respective axis or axes *7a*; this can be readily seen in FIGS. 8, 9 and 10. As can be seen by comparing FIGS. 6 and 7, the knuckles 16 at one end of a bar 2 are not or need not be aligned with the knuckles 16 at the other end of the same bar 2.

As already mentioned above, the number of knuckles 15 and/or 16 can be increased beyond the numbers shown in FIGS. 5 to 13 if the hinges 4 and/or 7 must transmit or stand very pronounced stresses or forces. Analogously, the number of knuckles 15 and/or 16 can be reduced under certain circumstances, e.g., when the improved building blocks form part of an educational toy, such as an erector kit for children or teenagers or even adults. For example, one end portion 6 of a bar 2 can carry a single knuckle 15 at each of the two edges 8, 9 and a single knuckle 16, and the other end portion 6 of the same bar can carry two knuckles 15 at each of the edges 8, 9 and a pair of knuckles 16. When two bars 2 of the type shown in FIGS. 5 to 13 are coupled to each other, the knuckles 16 at the left-hand end of the illustrated bar are moved into alignment with the knuckles 16 at the right-hand end of the bar (forming part of a discrete second building block) which is to be articulately coupled with the bar of FIGS. 5 to 13.

The construction of bars 2 in a manner as shown in FIGS. 5 to 13 has been found to be highly advantageous because it contributes to versatility of building blocks employing such bars and also because only one type of bars is needed to assemble all kinds of frames with little loss in time and in a simple manner which can be readily grasped by children or unskilled adults.

If the intended use of the building blocks embodying the present invention is known in advance (e.g., if such building blocks are to be used exclusively for the assembly of a frame of the type shown in FIG. 14 or 15 or 16 or 17 or 18 or 19), the knuckles 15 along the edge 8 or 9 of each bar 23 can be omitted. This reduces the cost of making the bars 2 and hence the cost of the entire building block or skeleton frame employing two or more improved building blocks.

It is further possible to employ reinforcing elements in the form of braces or the like to further enhance the stability of an assembled skeleton frame or of the building system which employs a frame consisting of two or more improved building blocks. For example, if the frame includes several rectangular or square portions, each such portion can be reinforced by a brace extending substantially diametrically from one corner toward the opposite corner of the polygonal portion. In other words, a reinforcing brace B can extend, for example, from the junction 10' to the junction 10'' in the frame of FIG. 16, 18 or 19. The end portions of braces B can include eyelets or knuckles which are aligned with the adjacent knuckles 16 forming part of the respective hinges 7, and the knuckles of the braces B can be traversed by the respective pintles PP to even further enhance the stability of the properly assembled frame.

The bars 2 can be made of wood, a metallic material (e.g., steel or a lightweight metal or alloy) or a suitable plastic material. For example, each bar 2 can constitute a laminate containing several layers of plywood and/or other material bonded to each other by a suitable adhesive. If the bars 2 are made of a metallic or plastic material, they can be mass-produced in a suitable extruding machine. The thus obtained continuous bar or bars are subdivided at required intervals to constitute bar-like extrusions of desired length.

The knuckles 15 and/or 16 can also be made of a suitable plastic and/or metallic material. The dimensions and/or the material of such knuckles will be selected with a view to meet the norms as to the required stability and reliability, e.g., as prescribed by building authorities. The knuckles can be separately produced parts which have portions embedded or anchored in the respective bars 2, or such knuckles can be made of one piece with the respective bars, especially if the bars are made of a plastic or metallic material. It is also possible to design the knuckles in such a way that they can be secured to selected portions of bars 2 by snap action, by male and female detent elements or in an analogous manner, especially if the hinges 4 and/or 7 are not called upon to transmit large forces (e.g., when the building blocks of the present invention are used in erector kits for children or in other toy devices).

Though the frames which are shown in FIGS. 14 to 19 constitute or resemble cupolas, domes or like structures, the improved building blocks can be assembled into a wide variety of other frame structures which can be put together and dismantled for educational purposes or for entertainment purposes as well as to constitute frame structures of a more or less permanent nature, e.g., in buildings. For example, the building blocks of the present invention can be assembled into ladder-like frames or other devices which are used for climbing or resemble a device to be climbed. It is further possible to assemble the improved building blocks into structures which serve purely decorative purposes (e.g., into balls or substantially spherical bodies of the type shown in FIGS. 16 and 17), to assemble the building blocks into devices (e.g., kiosks) which are to be used as a means for displaying goods and/or printed matter and/or images. Another presently contemplated use of the improved building blocks is for the making of racks, pavilions at fairs and exhibitions, turrets, cabins and/or analogous structures.

An important advantage of the improved building blocks is their versatility. For example, the angle between two elongated bars 2 of a building block can be infinitely varied by pivoting such bars relative to each other about the axis *4a* of the hinge 4. The angle between two neighboring building blocks can be infinitely varied by pivoting the blocks about an axis *7a*. Furthermore, the building blocks are simple and their constituents can be mass-produced in available machines. Still further, the hinges 7 can transmit substantial torque between the coupled-together building blocks, and the hinges 7 are readily accessible to permit rapid coupling or disengagement of building blocks which can be identical or similar to each other or which can be quite different as long as they can be coupled to each other by hinges 7 or by analogous securing means.

The improved building blocks can be mass-produced in large numbers and shipped to the locale of use. Alternatively, such building blocks can be assembled into skeleton frames or other types of systems right at the manufacturing plant. The cross-sectional outline and/or the length of each bar 2 can be selected practically at will to be optimally suited for a particular purpose. Moreover, the strength of the connections including the hinges 4 and/or 7 can also be selected practically at will.

The feature that the points 11 are located outside of the respective bars 2 is desirable and advantageous on the ground that this simplifies the assembly and the taking apart of a skeleton frame employing two or more building blocks of the aforedescribed character. The length of the bars 2 does not change and need not be changed preparatory to pivoting of the bars 2 forming part of a given building block about the axis 4*a* and/or preparatory to pivoting of two neighboring blocks relative to each other about an axis 7*a*.

The aforediscussed braces B or analogous reinforcing elements constitute an optional feature of the improved skeleton frame. The reason is that a pronounced stability of such frame is ensured as soon as the neighboring building blocks are properly coupled to each other by hinges 7; such connections can stand pronounced torsional as well as many other stresses.

By changing the inclination of the facets 14, one can change the extent of pivotability of interconnected building blocks relative to each other. For example, the angle between a facet 14 and the respective side 5 can be in the range of 20°; this ensures that two building blocks which are connected to each other by a hinge 7 can be pivoted through angles of up to 140° without unduly weakening the bars 2 in the regions of their facets 14.

The hinges 4 are preferably designed to permit two interconnected bars 2 in a particular building block to pivot relative to each other through an angle of up to 90°. This is desirable and advantageous because the sides 12 can be moved to any one of a practically infinite number of different positions best suited to properly support the end portions or marginal portions of panels 13 or like coverings including partly spherical and analogous complex coverings. The movability of sides 12 to a number of different positions relative to the sides 12 of adjacent bars 2 renders it possible to avoid the utilization of ribs, channels, ledges or analogous stops for the marginal portions or end portions of planks, panels 13 or the like. This reduces the cost of the building blocks as well as of the frames which employ such building blocks.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A building block for use in conjunction with additional building blocks, comprising two elongated rod-shaped components each having at least one longitudinally extending edge and two end portions; means for articulately connecting said elongated rod-shaped components at said edges for angular movement about a first axis; and a plurality of coupling means, at least one for each of said components and each including means for articulately securing one end portion of the respective component to a component of an additional block for angular movement about a second axis which is normal to said first axis, said first axis and said second axis crossing each other at a common point outside of said elongated rod-shaped components, at least one of said elongated rod-shaped components having a facet adjacent the respective second axis and positioned to limit the extent of angular movability of the at least one elongated rod-shaped component about the respective second axis relative to a component of an additional block which is articulately secured to the at least one elongated component by the respective coupling means, said facet being inclined relative to said one longitudinally extending edge.

2. The building block of claim 1, wherein said connecting means comprises a first hinge and each of said securing means forms part of a discrete second hinge.

3. The building block of claim 2, wherein each of said elongated rod-shaped components is a bar and said bars are parallel to each other.

4. The building block of claim 1, wherein each of said elongated rod-shaped components has a substantially rectangular cross-sectional outline and an elongated side flanked by two longitudinally extending edges including the respective at least one edge.

5. The building block of claim 4, wherein said at least one end portion of each of said elongated rod-shaped components is substantially normal to the first axis, said second axes being adjacent the elongated sides of the respective elongated rod-shaped components.

6. The building block of claim 1, wherein said connecting means comprises at least one knuckle at each end portion of each of said elongated rod-shaped components, the knuckles of one of said elongated rod-shaped components being aligned with the knuckles of the other of said elongated rod-shaped components and said connecting means further comprising a pintle defining said first axis and extending through said aligned knuckles.

7. The building block of claim 6, wherein at least one knuckle of one of said elongated rod-shaped components is disposed between two knuckles of the other of said elongated rod-shaped components.

8. The building block of claim 6, wherein said pintle includes a plurality of discrete coaxial sections.

9. The building block of claim 1, wherein each of said elongated components has two mutually inclined sides disposed in planes such that said planes cross each other along said first axis.

10. The building block of claim 1, wherein at least one of said securing means comprises at least one knuckle provided on the one end portion of the respective elongated rod-shaped component and arranged to receive a pintle further extending through at least one knuckle at one end portion of an elongated rod-shaped component of an additional building block.

11. The building block of claim 10, wherein said at least one securing means comprises a plurality of spaced apart aligned knuckles.

12. The building block of claim 1, wherein said elongated rod-shaped components are mirror images of each other with reference to a plane including said first axis.

13. The building block of claim 1, wherein each of said elongated rod-shaped components has a first side flanked by two longitudinally extending edges including the respective at least one edge and a second edge, and a second side inclined relative to said first side, said first and second sides flanking said second edge.

14. The building block of claim 13, wherein said first and second sides are at least substantially normal to each other.

15. The building block of claim 1, wherein at least one of said elongated rod-shaped components contains wood.

16. The building block of claim 1, wherein at least one of said elongated rod-shaped components contains a metallic material.

17. The building block of claim 1, wherein at least one of said elongated rod-shaped components contains a plastic material.

18. The building block of claim 1, wherein at least one of said elongated components is an extrusion.

19. The building block of claim 1, wherein at least a portion of at least one of said connecting means and said securing means consists of a metallic material.

20. The building block of claim 1, wherein at least a portion of at least one of said connecting means and said securing means consists of a plastic material.

21. The building block of claim 1, wherein at least one of said connecting and securing means comprises elements affixed to one of said elongated rod-shaped components by snap action.

22. The building block of claim 21, wherein said elements contain a plastic material.

23. The building block of claim 1, wherein at least one of said connecting means and said securing means comprises elements of one piece with one of said elongated rod-shaped components.

24. The building block of claim 23, wherein said elements contain a metallic material.

25. The building block of claim 23, wherein said elements contain a plastic material.

* * * * *